US006251825B1

(12) United States Patent
Richardson

(10) Patent No.: US 6,251,825 B1
(45) Date of Patent: Jun. 26, 2001

(54) RE-TRANSFER INTERMEDIATE SHEET FOR THERMAL TRANSFER PRINTING

(75) Inventor: Christopher Paul Richardson, Whatfield (GB)

(73) Assignee: Imperial Chemical Industries PLC, London (GB)

( * ) Notice: Subject to any disclaimer, the term of this patent is extended or adjusted under 35 U.S.C. 154(b) by 0 days.

(21) Appl. No.: 09/230,227

(22) PCT Filed: Jul. 3, 1997

(86) PCT No.: PCT/GB97/01760

§ 371 Date: Aug. 16, 1999

§ 102(e) Date: Aug. 16, 1999

(87) PCT Pub. No.: WO98/02315

PCT Pub. Date: Jan. 22, 1998

(51) Int. Cl.[7] ..... B41M 5/035; B41M 5/38

(52) U.S. Cl. ..... 503/227; 156/235; 428/195; 428/323; 428/327; 428/331; 428/913; 428/914

(58) Field of Search ..... 8/471; 503/227; 156/235; 428/195, 323, 327, 331, 913, 914

(56) References Cited

FOREIGN PATENT DOCUMENTS 672 542 9/1995 (EP) .
1-99888 4/1989 (JP) .
1-241491 9/1989 (JP) .
93/09955 5/1993 (WO) .
94/05505 3/1994 (WO) .

*Primary Examiner*—Bruce H. Hess
(74) *Attorney, Agent, or Firm*—Pillsbury Winthrop LLP

(57) ABSTRACT

A new re-transfer intermediate sheet comprising a supporting substrate having on one side an imageable layer and on the other a backcoat, is provided for thermal transfer printing of an article having a dye-receptive surface, by thermal retransfer. This method of printing comprise the steps of pressing together a dye-donor sheet and the imageable layer of the retransfer intermediate sheet, forming an image in the imageable layer by thermal transfer printing, pressing the thus-formed image-containing layer against the dye-receptive surface of the article, and applying heat to the intermediate sheet to effect retransfer of the image to the dye-receptive layer of the article. To improve protection against the physical conditions experienced in such retransfer process, the backcoat of the new intermediate sheet comprises a polymeric binder and a high loading of protective filler, preferably in amount of 100% to about 250% by weight of the binder.

14 Claims, No Drawings

RE-TRANSFER INTERMEDIATE SHEET FOR THERMAL TRANSFER PRINTING

This application is the national phase of international application PCT/GB97/01760 filed Jul. 3, 1997 which designated the U.S.

The invention relates to thermal transfer printing of an article by forming an image in an intermediate sheet by thermal transfer and thereafter thermally retransferring the image to a dye-receptive layer on the article; and in particular to the composition of the retransfer intermediate sheet.

Thermal transfer printing is a process in which one or more thermally transferable dyes are caused to transfer from selected areas of a dye-donor sheet to a receiver by thermal stimuli, thereby to form an image. This is generally carried out in a printer having a thermal head or laser energy source, depending on the kind of dye-donor sheet used. Using a dye-donor sheet comprising a thin substrate supporting a dyecoat containing one or more uniformly spread dyes, printing is effected by heating selected discrete areas of the dye-donor sheet while the dyecoat is pressed against a dye-receptive surface of a receiver sheet, thereby causing dye to transfer to corresponding areas of the receiver. The shape of the image transferred is determined by the number and locations of the discrete areas which are subjected to heating. Full colour prints can be produced by printing with different coloured dyecoats sequentially in like manner, and the different coloured dyecoats are usually provided as discrete uniform panels arranged in a repeated sequence along a ribbon-shaped dye-donor sheet.

In order to print articles other than flexible sheets, one method that is commonly used is thermal retransfer. This is a two stage process, employing a retransfer intermediate sheet comprising a supporting substrate having a dye-receptive imageable layer on one side, usually with a backcoat on the other side to promote good transport through the initial printer. In the first stage, an image is formed as above by pressing together a dye-donor sheet and the imageable layer of the intermediate sheet, and applying heat to selected positions of the dye-donor sheet to cause transfer of dye into that imageable layer, thereby to produce the image.

The image-containing intermediate sheet is then separated from the dye-donor sheet, and in the second stage of the process, is pressed against the article, with its image-containing layer contacting a dye-receptive surface of the article. Heat is then applied to effect transfer of the image, usually over the whole area of the image simultaneously and in a press shaped to accommodate the article. Alternatively with some appropriately shaped articles, heated rolls may be used to provide the heat as the intermediate sheet and article are fed through. Thus although thermal retransfer techniques can be used for printing laminar articles such as stiff cards, they are of particular applicability to the printing of three dimensional articles such as mugs.

Not all of the dye which forms the image can retransfer to the article in the thermal retransfer process, but the higher the proportion which can be caused to retransfer, the more intense will be the colours in the printed article. The proportion which does retransfer depends on, amongst other things, the composition of the dye-receptive surface of the article. This may be the natural surface of that article where the latter is formed of an appropriately dye-receptive material, but in most instances it is usual first to provide the article with a coating to form a surface of enhanced dye-receptivity.

A further factor influencing the degree of retransfer is the amount of heat applied in the second, i.e. retransfer, stage.

Heated presses shaped according to the mug or other article to be printed, have been sold by a number of manufacturers, and typically these develop temperatures of 140–180° C. Under such conditions, the intermediate sheet can degrade, leaving debris in the press and ultimately sticking to the press when it is opened, causing defects to occur in the retransferred image. We have now developed a heat resistant backcoat composition to provide retransfer intermediate sheets with improved protection against the physical conditions experienced in such retransfer presses.

Accordingly, one aspect of the invention provides a re-transfer intermediate sheet for thermal transfer printing of an article by thermal retransfer, the intermediate sheet comprising a supporting substrate having on one side an imageable layer and on the other a backcoat, wherein the backcoat is a heat-resistant layer comprising a polymeric binder and a protective particulate filler in an amount of at least 50% by weight of the binder.

According to a further aspect of the invention, a method of printing an article having a dye-receptive surface comprises the steps of pressing together a dye-donor sheet and an imageable layer of a retransfer intermediate sheet comprising a supporting substrate having on one side the imageable layer and on the other a backcoat, forming an image in the imageable layer by thermal transfer printing, pressing the thus-formed image-containing layer against the dye-receptive surface of the article, and applying heat to the intermediate sheet to effect retransfer of the image to the dye-receptive layer of the article, characterised in that the backcoat is a heat-resistant layer comprising a polymeric binder and a protective particulate filler in an amount of at least 50% by weight of the binder.

The protective filler most suitably comprises mainly particles of 1–10 $\mu$m mean diameter.

For the purpose of providing thermal resistance, the type of particle is less critical than the proportion used relative to the binder, although other properties may influence the optimum choice. We have used to good effect organic particles in the form of a poly(alkylsilylsesquioxane) compound, such as the methyl substituted compounds marketed in various particle sizes under the trade mark Tospearl, by Toshiba. Equally effective in providing heat resistance are inorganic particulates such as hydrated alumina and the like. However the organic particles are generally preferred, in view of the more abrasive nature of compositions with high loadings of hydrated alumina. Examples of poly (alkylsilylsesquioxane) particulate compounds available commercially include KMP-590 (Shinetsu Chemical); Tospearl 105, Tospearl 108, Tospearl 120, Tospearl 130, Tospearl 145 and Tospearl 240 (Toshiba Silicone); and Torefil R-925 and Torefil 930 (Toray Dow Corning).

Compared with retransfer intermediate sheets with backcoats containing only small quantities of particles, typically about 1–10% by weight of the binder in the past, we find we obtain a noticeable improvement in heat resistance with as little as 50% by weight of the binder. However we prefer to use at least 100%, especially at least 200% by weight of the binder, as the improvement in heat resistance increases with increased loading. At higher loadings, other properties of the backcoat can deteriorate, e.g. to become less readily coatable as a composition during manufacture, or more brittle once dried as a coating, but this depends on the resin used for the binder and on the nature of the particles selected. Some of these difficulties with high filler loadings can be mitigated by incorporating other additives into the composition. For example, in the preferred embodiments using particles at loadings of about 200% by weight of the binder or above, we prefer to include a metal phosphate salt of stearic acid in an amount of from 1 to 20% of the binder, to stabilise the solution and improve manufacturability. It may similarly be added to compositions containing lower particle loadings, but the lower the loading levels, the less is this of benefit. Subject to the above limitations, our preferred range for the amount of protective filler is generally from 100% to about 250% by weight of the binder.

Where other particles are also incorporated, it may be necessary to use less of the protective 1–10 μm particles than the maximum quantity that could otherwise be used. Examples of such other particles which may usefully be added include slightly larger particles added as an anti-blocking agent to improve handling. Our preferred anti-blocking agent comprises particles of 8–15 μm mean diameter, in an amount of 10–25% by weight of the binder.

Suitable binders include cellulosic resins, such as cellulose acetate proprionate and cellulose acetate butyrate. The binder need not be cross-linked in order to benefit in terms of heat resistance from the present high loadings of particulates. However, we generally do prefer to provide some degree of cross-linking by the addition of small amounts of crosslinking agent. The cellulose resins can be crosslinked by isocyanates or by melamine cross linking agents in acid conditions.

The dried backcoat of the invention is preferably within a thickness range of 1–10 μm, especially 1–5 μm, as thicker backcoats provide little extra protection, and lead to lower versatility, especially during the first, image-forming, stage.

The supporting substrate may typically be paper, especially polyolefin-coated paper. This is a support material which provides a very good quality of retransferred image, but which was particularly prone to heat induced problems during retransfer prior to the protection afforded by the present backcoats.

The invention is illustrated by the following Examples.

EXAMPLE 1

A backcoat composition A was prepared, and coated onto a substrate of polyethylene coated paper, then dried to give a coating of thickness 3 μm. An imageable layer had previously been coated onto the other side of the polyethylene coated paper, to complete a retransfer intermediate sheet according to the invention.

| backcoat composition A | |
|---|---|
| cellulose acetate proprionate (CAP) (482-0.5 - from Eastman Kodak) | 31.45 wt % |
| Atmer 190 (antistatic agent) | 0.5 wt % |
| Beetle 692 (melamine cross-linker) | 1.66 wt % |
| p-toluene sulphonic acid catalyst | 0.33 wt % |
| Tegomer 2311 (silicone levelling agent) | 0.03 wt % |
| Tospearl 120 (particles - 2.0 μm mean diameter) | 62.89 wt % |
| calcium stearyl phosphate (stabiliser) | 3.14 wt % |

(Atmer is a trade mark of ICI, Beetle 692 is a trade mark of British Industrial Plastics, Tegomer 2311 is a trade mark of Goldschmidt and Tospearl is a trade mark of Toshiba.)
In this composition the amount of the particulate Tospearl is approximately 200% by volume of the binder (CAP).

EXAMPLES 2–4

Three further intermediate sheets were prepared according to the invention, using corresponding compositions but wherein the filler contents were changed as follows:

Composition B Tospearl 120 at 100% by weight of the binder

Composition C Tospearl 120 at 50% by weight of the binder

Composition D Apyral at 100% by weight of the binder (Apyral is a trade mark of QLT in respect of hydrated alumina filler)

Test results

To evaluate the retransfer intermediate sheets prepared in Examples 1–4 above, they were used to print mugs in a standard mug-printing press, and as a control, a previous retransfer sheet containing particles but only in an amount of approximately 1% by weight of the binder, was similarly tested.

Each intermediate sheet was printed with blocks of colour, in a thermal transfer printer whose heat source was a thermal head having a row of programmable pixel heaters, in normal manner. Using a mug-shaped heatable press, each imaged intermediate sheet was placed in the press together with a mug precoated with a resin to give a dye-receptive surface against which was placed the imaged layer of the intermediate sheet. The press was then activated to apply heat and pressure to the back of the intermediate sheet, to thermally retransfer dyes from the intermediate sheet into the dye-receptive surface layer of the mug. At the end of each retransfer process, the press was opened, and the printed mug removed. Both the press and the image retransferred into the mug were examined, and the results were as shown in the table below,

| BACKCOAT COMPOSITION | RESULT |
|---|---|
| Composition A | + + |
| Composition B | + |
| Composition C | o |
| Composition D | + + |
| Control sheet | – – |

where:

xx=excellent x=very good o=OK but room for improvement

--=unsatisfactory

EXAMPLE 5

A retransfer intermediate sheet according to the invention was prepared essentially as described in Example 1, except that a anti-blocking agent was also added to the backcoat composition (composition E) to improve handling.

| backcoat composition E | |
|---|---|
| cellulose acetate proprionate (CAP) (482-0.5 - from Eastman Kodak) | 100 parts by weight |
| Tospearl 120 (protective particles - 2.0 μm mean diameter) | 200 parts by weight |
| Pergopak (anti-block particles - 8–15 μm mean diameter) | 17 parts by weight |
| calcium stearyl phosphate (stabiliser) | 10 parts by weight |
| Beetle 692 (melamine cross-linker) | 5.0 parts by weight |
| p-toluene sulphonic acid catalyst | 1.0 parts by weight |

-continued

| backcoat composition E | |
|---|---|
| Atmer 190 (antistatic agent) | 1.5 parts by weight |
| Tegomer 2311 (silicone levelling agent) | 0.1 parts by weight |

(Pergopak is a trade mark of Martinswerk)

The retransfer intermediate sheet thus prepared was used to print mugs in a standard mug-printing press, essentially as described for Examples 1–4. Handling during printing was excellent. When the press was opened and the printed mug removed after the retransfer process, both the press and the image retransferred into the mug were examined and found to be in excellent condition, with no significant degradation of the retransfer sheet being apparent.

What is claimed is:

1. A re-transfer intermediate sheet for thermal transfer printing of an article by thermal retransfer, comprising a supporting substrate having on one side an imageable layer and on the other a backcoat, wherein the backcoat is a heat-resistant layer comprising a polymeric binder and protective particulate filler, characterized in that the protective particulate filler is included in an amount of at least 100% by weight of the binder, the amount of filler being such that the backcoat is rendered resistant to degradation by heat applied thereto when said sheet issued in thermal re-transfer printing of an article.

2. A retransfer intermediate sheet according to claim 1, wherein the protective filler mainly comprises particles of 1–10 $\mu$m mean diameter.

3. A retransfer intermediate sheet according to claim 2, wherein the protective filler mainly comprises organic particles.

4. A retransfer intermediate sheet according to claim 3, wherein the organic particles comprise a poly (alkylsilylsesquioxane).

5. A retransfer intermediate sheet according to claim 2, wherein the protective filler mainly comprises inorganic particles.

6. A retransfer intermediate sheet according to claim 2, wherein the backcoat composition contains the protective filler in an amount of at least about 200% by weight of the binder.

7. A retransfer intermediate sheet according to claim 2, wherein the backcoat composition contains the protective filler in an amount of 100% to about 250% by weight of the binder.

8. A retransfer intermediate sheet according to claim 1, wherein the heat-resistant layer contains an anti-blocking agent comprising particles of 8–15 $\mu$m mean diameter, in an amount of 10–25% by weight of the binder.

9. A retransfer intermediate sheet according to claim 1, wherein the backcoat composition contains a metal phosphate salt of stearic acid in an amount of from 1 to 20% by weight of the binder.

10. A retransfer intermediate sheet according to claim 1, wherein the binder is a cellulosic resin.

11. A retransfer intermediate sheet according to claim 1, wherein the polymeric binder is cross-linked.

12. A retransfer intermediate sheet according to claim 11, wherein the protective filler comprises poly (methylsilysesquioxane) particles of 1–10 $\mu$m mean diameter.

13. A method of printing an article having a dye-receptive surface comprising the steps of pressing together a dye-donor sheet and an imageable layer of a retransfer intermediate sheet comprising a supporting substrate having on one side the imageable layer and on the other a backcoat, forming an image in the imageable layer by thermal transfer printing, pressing the thus-formed image-containing layer against the dye-receptive surface of the article, and applying heat to the intermediate sheet to effect retransfer of the image to the dye-receptive layer of the article, wherein the backcoat is a heat resistant layer comprising a polymeric binder and a protective particular filler, characterized in that the protective particulate filler is included in an amount of at least 100% by weight of the binder, the amount of said filler being such as to render said backcoat resistant to degradation by the heat applied to effect the retransfer.

14. A retransfer intermediate sheet for thermal transfer printing of an article by thermal retransfer, comprising a supporting substrate having on one side an imageable layer and on the other a backcoat, wherein the backcoat is a heat-resistant layer comprising a polymeric binder and a protective particulate filler, characterized in that the protective particulate filler is selected from poly (alkylsilylsesquioxane) compounds and hydrated alumina fillers in an amount of at least 100% by weight of the binder.

* * * * *